US006643980B1

(12) United States Patent
Dorder et al.

(10) Patent No.: US 6,643,980 B1
(45) Date of Patent: Nov. 11, 2003

(54) DOOR JAMB SAFETY DEVICE

(76) Inventors: Alvin O. Dorder, 1218 Dundas St E, Oakville Ont L6J 4Z2 (CA); Kyungwon Kang, 3400 River Spray Cres #1201, Mississauga Ont L4Y 3M5 (CA)

( * ) Notice: Subject to any disclaimer, the term of this patent is extended or adjusted under 35 U.S.C. 154(b) by 0 days.

(21) Appl. No.: 10/076,464

(22) Filed: Feb. 15, 2002

(51) Int. Cl.[7] ..... E06B 7/16
(52) U.S. Cl. ..... 49/383; 49/460
(58) Field of Search ..... 49/460, 383, 462; 160/40; 16/250, 251

(56) References Cited

U.S. PATENT DOCUMENTS 2,694,234 A * 11/1954 Roby et al. ..... 16/250
3,302,690 A * 2/1967 Hurd ..... 16/250
4,261,140 A 4/1981 McLean
4,290,233 A 9/1981 Hubbard
5,001,862 A 3/1991 Albenda
5,220,708 A * 6/1993 Lucas et al. ..... 16/225
5,359,812 A 11/1994 Mayfield
5,419,084 A * 5/1995 Sankey et al. ..... 16/250
D372,191 S 7/1996 Bennet
6,134,839 A * 10/2000 Johansson ..... 16/258
6,141,909 A 11/2000 Hanson

* cited by examiner

*Primary Examiner*—Gregory J. Strimbu

(57) ABSTRACT

A door jamb safety device for inhibiting insertion of fingers between a door and a door jamb. The door jamb safety device includes a frame member for coupling to the door jamb and a door member for coupling to the door. The door member is hingably coupled to the frame member whereby the door member may pivot with respect to the frame member when the door is opened and closed. The door member has a blocking portion with proximal and distal portions being angled at approximately 90 degrees to each other.

4 Claims, 3 Drawing Sheets

DOOR JAMB SAFETY DEVICE

BACKGROUND OF THE INVENTION

1. Field of the Invention

The present invention relates to door entry guards and more particularly pertains to a new door jamb safety device for inhibiting insertion of fingers between a door and a door jamb.

2. Description of the Prior Art

The use of door entry guards is known in the prior art. U.S. Pat. No. 6,141,909 describes a device for preventing insertion of go fingers between the door and the door jamb to prevent the fingers being injured. Another type of door entry guard is U.S. Pat. No. 5,001,862 having a protector mounted to a door and door jamb to prevent fingers from being pinched between the door and the door jamb.

SUMMARY OF THE INVENTION

An object of the present invention is to provide a new door jamb safety device that prevents access to an area between the door and a door jamb to prevent injury to fingers being pinched between the door and the door jamb.

Even still another object of the present invention is to provide a new door jamb safety device that allows for the door to be easily closed.

To this end, the present invention generally comprises a frame member being designed for coupling to the door jamb. A door member is designed for coupling to the door. The door member is hingably coupled to the frame member whereby the door member is pivotal with respect to the frame member when the door is opened and closed with respect to the door jamb. The door member and the frame member is designed for is positioned between the door and the door jamb whereby the door member and the frame member are for inhibiting access to the area between the door and the door jamb to prevent fingers is pinched between the door and the door jamb when the door is being pivoted with respect to the door jamb.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
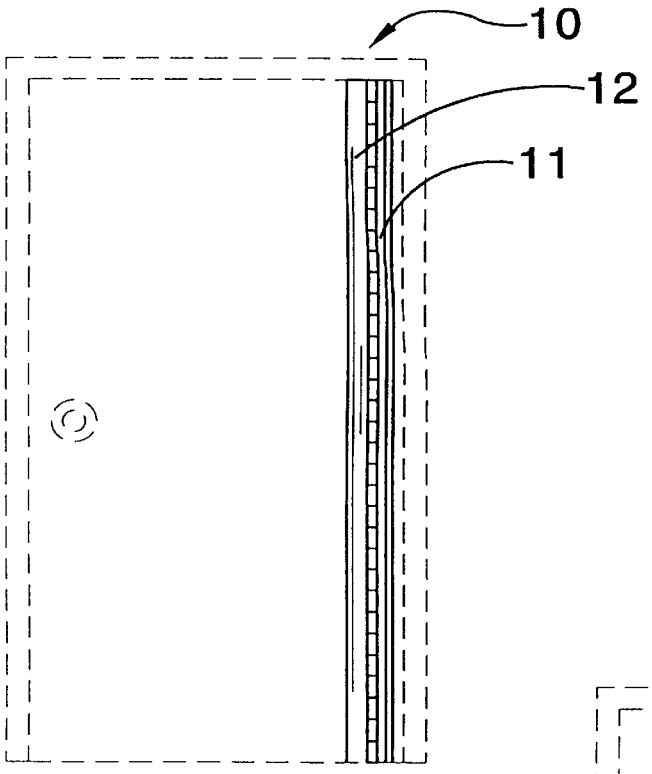
FIG. 1 is a front view of a new door jamb safety device according to the present invention in use on the door that is closed.
Figure 2:
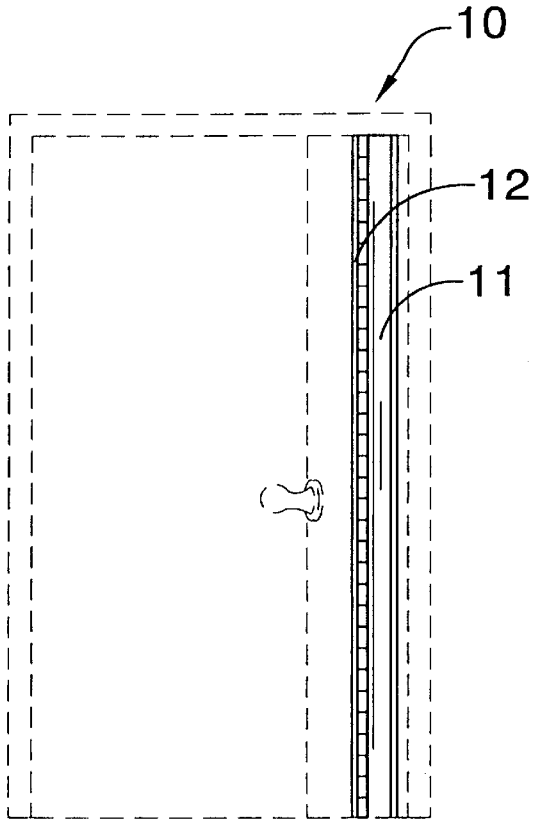
FIG. 2 is a front view of the present invention in use on the door that is used.
Figure 3:
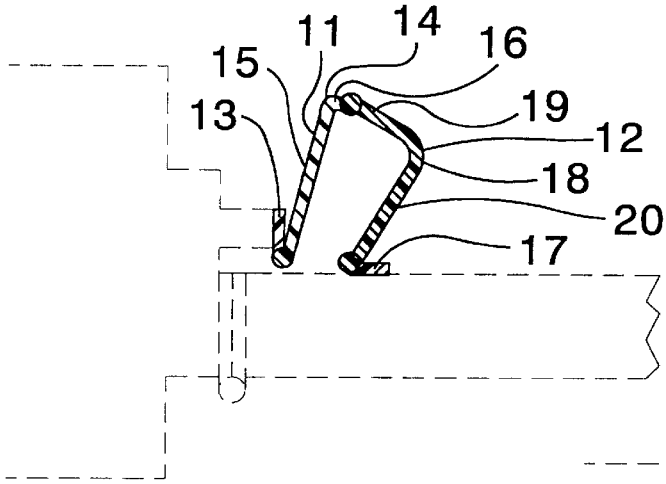
FIG. 3 is a cross-sectional view of the present invention shown with the door in a closed position.
Figure 4:
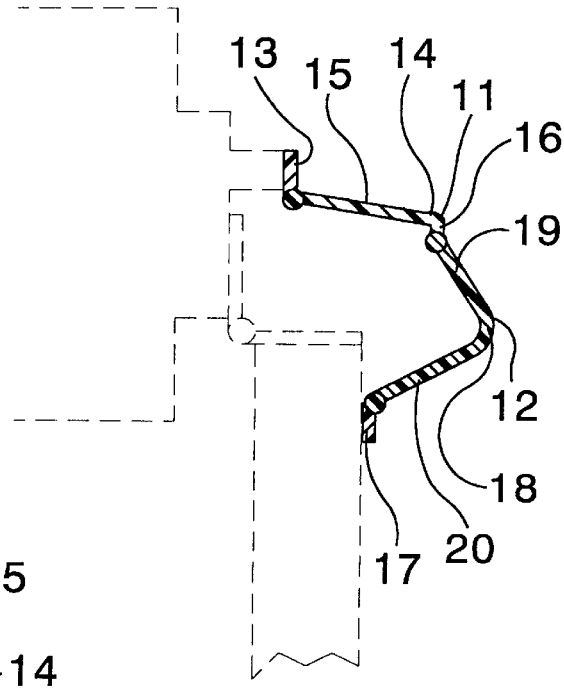
FIG. 4 is a cross-sectional view of the present invention shown with the door in a partially open position.
Figure 5:
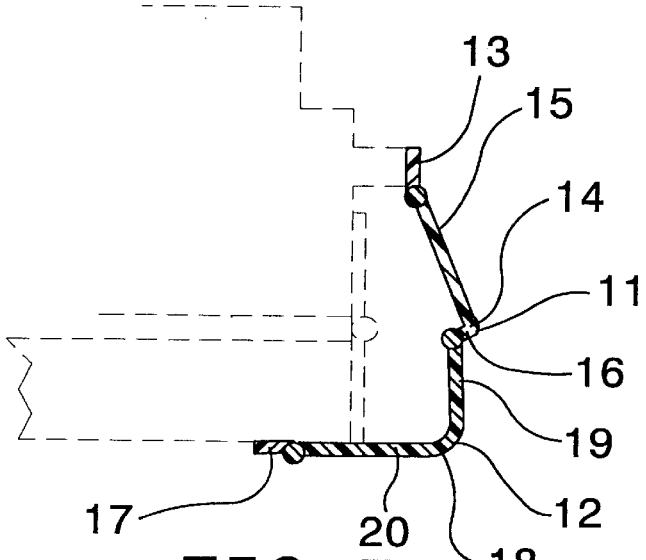
FIG. 5 is a cross-sectional view of the present invention shown with the door in a fully open position.
Figure 6:
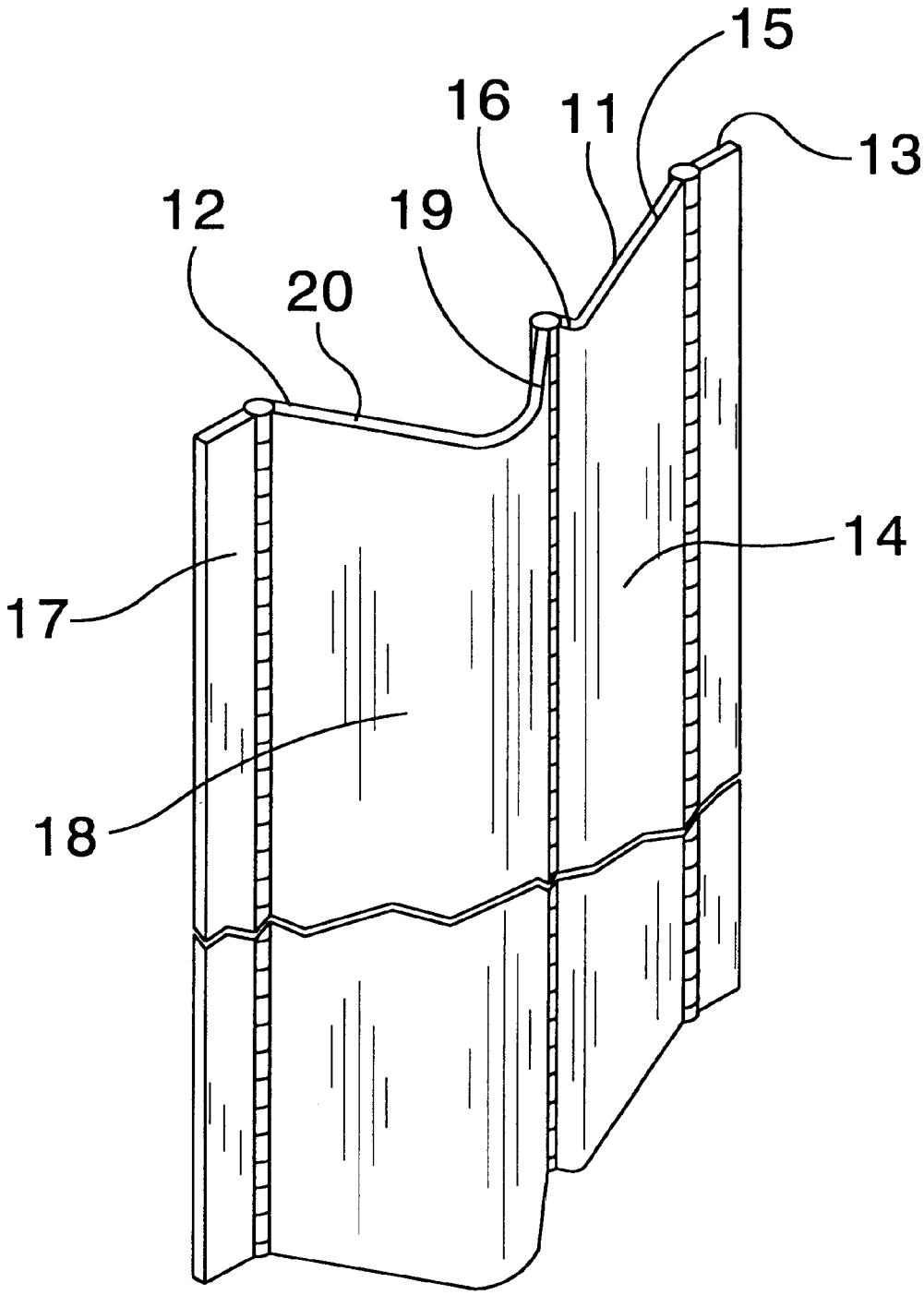
FIG. 6 is a perspective view of the present invention.

With reference now to the drawings, and in particular to FIGS. 1 through 6 thereof, a new door jamb safety device embodying the principles and concepts of the present invention and generally designated by the reference numeral 10 will be described.

As best illustrated in FIGS. 1 through 6, the door jamb safety device 10 generally comprises a frame member 11 being designed for coupling to the door jamb.

A door member 12 is designed for coupling to the door. The door member 12 is hingably coupled to the frame member 11 whereby the door member 12 is pivotal with respect to the frame member 11 when the door is opened and closed with respect to the door jamb. The door member 12 and the frame member 11 are designed for being positioned between the door and the door jamb whereby the door member 12 and the frame member 11 are for inhibiting access to the area between the door and the door jamb to prevent fingers being pinched between the door and the door jamb when the door is being pivoted with respect to the door jamb.

The frame member 11 has a jamb mounting portion 13 and a guard portion 14. The jamb mounting portion 13 is hingably coupled to the guard portion 14. The guard portion 14 is hingably coupled to the door member 12. The jamb mounting portion 13 is designed for coupling to the door jamb. The guard portion 14 is designed for inhibiting insertion of fingers between the door and the door frame.

The guard portion 14 has a first portion 15 and a second portion 16. The first portion 15 is hingably coupled to the jamb mounting member. The second portion 16 is hingably coupled to the door member 12. The first portion 15 is positioned at an angle to the second portion 16 whereby force on the second portion 16 from the door member 12 directs the first portion 15 away from the door when the door is being closed. The angle between the first portion 15 and the second portion 16 is substantially 90 degrees for directing the first portion 15 away from the door when the door is being closed. The first portion 15 has length greater than a length of the second portion 16.

The door member 12 has a door mounting portion 17 and a blocking portion 18. The door mounting portion 17 is hingably coupled to the blocking portion 18. The blocking portion 18 is hingably coupled to the frame member 11. The door mounting portion 17 is designed for coupling to the door. The blocking portion 18 is designed for inhibiting insertion of fingers between the and the door frame.

The blocking portion 18 has a distal portion 19 and a proximal portion 20. The proximal portion 20 is hingably coupled to the door mounting portion 17. The distal portion 19 is hingably coupled to the frame member 11. The proximal portion 20 is positioned at an angle to the distal portion 19 whereby force on the proximal member from the door mounting portion 17 directs the distal portion 19 away from the door when the door is being closed. The angle between the proximal portion 20 and the distal portion 19 is substantially 90 degrees for directing the distal portion 19 away from the door when the door is being closed. The proximal portion 20 has length greater than a length of the distal portion 19.

In use, the user couples the jamb mounting portion 13 to the door jamb and the door mounting portion 17 to the door. The blocking portion 18 and the guard portion 14 prevent fingers from being inserted between the door frame and the door when the door is being closed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A door jamb safety device for protecting fingers of a user from becoming pinched between a door and a door jamb, the door jamb safety device comprising:

a frame member being adapted for coupling to the door jamb;

a door member being adapted for coupling to the door, said door member being hingably coupled to said frame member such that said door member is pivotal with respect to said frame member when the door is opened and closed with respect to the door jamb, said door member and said frame member being adapted for being positioned between the door and the door jamb such that said door member and said frame member are for inhibiting access to an area between the door and the door jamb to prevent the fingers being pinched between the door and the door jamb when the door is being pivoted closed with respect to the door jamb;

said frame member having a jamb mounting portion and a guard portion, said jamb mounting portion being hingably coupled to said guard portion, said guard portion being hingably coupled to said door member, said jamb mounting portion being adapted for coupling to the door jamb, said guard portion being adapted for inhibiting insertion of the fingers between the door and the door jamb; and said guard portion having a first portion and a second portion, said first portion being hingably coupled to said jamb mounting portion, said second portion being hingably coupled to said door member, said first portion being rigidly coupled to said second portion such that said second portion is positioned opposite said jamb mounting portion, said first portion being positioned at a fixed substantially 90 degree angle to said second portion such that a force on said second portion from said door member directs said guard portion away from the door when the door is being closed;

wherein said door member has a door mounting portion and a blocking portion, said door mounting portion being hingably coupled to said blocking portion, said blocking portion being hingably coupled to said frame member, said door mounting portion being adapted for coupling to the door, said blocking portion being adapted for inhibiting insertion of the fingers between the door and the door jamb;

wherein said blocking portion has a distal portion and a proximal portion, said proximal portion being hingably coupled to said door mounting portion, said distal portion being hingably coupled to said frame member, said proximal portion being positioned at a fixed substantially 90 degree angle to said distal portion such that a force on said proximal portion from said door mounting portion directs said distal portion away from the door when the door is being closed.

2. The door jamb safety device as set forth in claim 1, wherein said first portion has a length greater than a length of said second portion.

3. The door jamb safety device as set forth in claim 1, wherein said proximal portion has a length greater than a length of said distal portion.

4. A door jamb safety device for protecting fingers of a user from becoming pinched between a door and a door jamb, the door jamb safety device comprising:

a frame member being adapted for coupling to the door jamb;

a door member being adapted for coupling to the door, said door member being hingably coupled to said frame member such that said door member is pivotal with respect to said frame member when the door is opened and closed with respect to the door jamb, said door member and said frame member being adapted for being positioned between the door and the door jamb such that said door member and said frame member are for inhibiting access to an area between the door and the door jamb to prevent the fingers being pinched between the door and the door jamb when the door is being pivoted closed with respect to the door jamb;

said frame member having a jamb mounting portion and a guard portion, said jamb mounting portion being hingably coupled to said guard portion, said guard portion being hingably coupled to said door member, said jamb mounting portion being adapted for coupling to the door jamb, said guard portion being adapted for inhibiting insertion of the fingers of the user between the door and the door jamb;

said guard portion having a first portion and a second portion, said first portion being hingably coupled to said jamb mounting portion, said second portion being hingably coupled to said door member, said first portion being rigidly coupled to said second portion such that said second portion is positioned opposite said jamb mounting portion, said first portion being positioned at an angle to said second portion such that a force on said second portion from said door member directs said guard portion away from the door when the door is being closed;

said angle between said first portion and said second portion being substantially 90 degrees for directing said first portion away from the door when the door is being closed;

said first portion having a length greater than a length of said second portion;

said door member having a door mounting portion and a blocking portion, said door mounting portion being hingably coupled to said blocking portion, said blocking portion being hingably coupled to said frame member, said door mounting portion being adapted for coupling to the door, said blocking portion being adapted for inhibiting insertion of the fingers between the door and the door jamb;

said blocking portion having a distal portion and a proximal portion, said proximal portion being hingably coupled to said door mounting portion, said distal portion being hingably coupled to said frame member, said proximal portion being positioned at an angle to said distal portion such that a force on said proximal portion from said door mounting portion directs said distal portion away from the door when the door is being closed;

said angle between said proximal portion and said distal portion being substantially 90 degrees for directing said distal portion away from the door when the door is being closed; and said proximal portion having a length greater than a length of said distal portion.

* * * * *